US009418591B2

(12) United States Patent
Kim et al.

(10) Patent No.: US 9,418,591 B2
(45) Date of Patent: Aug. 16, 2016

(54) TIMING CONTROLLER, DRIVING METHOD THEREOF, AND DISPLAY DEVICE USING THE SAME

(71) Applicant: LG DISPLAY CO., LTD., Seoul (KR)

(72) Inventors: Jung-Gyum Kim, Paju-si (KR); Yeon Shim Shim, Paju-si (KR); Jin Young Oh, Paju-si (KR)

(73) Assignee: LG DISPLAY CO., LTD, Seoul (KR)

( * ) Notice: Subject to any disclaimer, the term of this patent is extended or adjusted under 35 U.S.C. 154(b) by 94 days.

(21) Appl. No.: 14/079,948

(22) Filed: Nov. 14, 2013

(65) Prior Publication Data

US 2014/0146071 A1 May 29, 2014

(30) Foreign Application Priority Data

Nov. 27, 2012 (KR) ..... 10-2012-0135478

(51) Int. Cl.
*G09G 5/02* (2006.01)
*G09G 3/32* (2016.01)

(52) U.S. Cl.
CPC ..... *G09G 3/3225* (2013.01); *G09G 2320/0233* (2013.01); *G09G 2320/0242* (2013.01); *G09G 2320/0271* (2013.01)

(58) Field of Classification Search
CPC ..... G09G 5/02; G06T 11/001; G06T 1/20; G06T 15/005; G06T 11/40; G06T 11/203; G06T 5/001; G06T 5/40; G06K 9/38
USPC ..... 345/418, 441, 442, 501, 581, 589; 382/254, 270, 274
See application file for complete search history.

(56) References Cited

U.S. PATENT DOCUMENTS

| | | | | |
|---|---|---|---|---|
| 5,740,285 | A * | 4/1998 | Bloomberg et al. | 382/299 |
| 6,055,025 | A * | 4/2000 | Shahraray | G06T 7/202 348/700 |
| 2002/0130892 | A1* | 9/2002 | Holtslag | 345/690 |
| 2007/0152926 | A1* | 7/2007 | Kwon | 345/82 |
| 2008/0042954 | A1* | 2/2008 | Lee et al. | 345/89 |
| 2010/0149340 | A1* | 6/2010 | Marks et al. | 348/169 |
| 2011/0057964 | A1* | 3/2011 | Kanazawa et al. | 345/690 |
| 2011/0293191 | A1* | 12/2011 | Shin et al. | 382/199 |
| 2012/0162156 | A1* | 6/2012 | Chen et al. | 345/204 |
| 2012/0177249 | A1* | 7/2012 | Levy et al. | 382/103 |
| 2013/0021496 | A1* | 1/2013 | Ranbro | H04N 9/735 348/223.1 |

* cited by examiner

*Primary Examiner* — Xiao Wu
*Assistant Examiner* — Sarah Lhymn
(74) *Attorney, Agent, or Firm* — Brinks Gilson & Lione

(57) ABSTRACT

A timing controller includes a logo detecting unit configured to compare a plurality of frames to detect a logo region, an edge detecting unit configured to detect an edge, corresponding to a boundary between the logo region and an external region of the logo region, from the logo region by using a change amount of brightness between the logo region and the external region, a brightness compensating unit configured to reduce a brightness of the logo region including the edge, and an output unit configured to output image data whose a brightness is compensated for by the brightness compensating unit.

14 Claims, 9 Drawing Sheets

TIMING CONTROLLER, DRIVING METHOD THEREOF, AND DISPLAY DEVICE USING THE SAME

CROSS-REFERENCE TO RELATED APPLICATIONS

This application claims the benefit of priority to Korean Patent Application No. 10-2012-0135478 filed on Nov. 27, 2012, which is hereby incorporated by reference as if fully set forth herein.

BACKGROUND

1. Field of the Disclosure

The present disclosure relates to a display device, and more particularly, to a timing controller, a driving method thereof, and a display device using the same, which can solve an image-sticking problem.

2. Discussion of the Related Art

Flat panel display (FPD) devices are used in a various electronic devices, such as portable phones, tablet personal computers (PCs), notebook computers, etc. The FPD devices include liquid crystal display (LCD) devices, plasma display panels (PDPs), organic light-emitting display devices, etc. Recently, electrophoretic display (EPD) devices are widely used as the FPD devices.

Among such display devices, organic light-emitting display devices use a plurality of self-emitting elements that self-emit light, and thus have a fast response time, a high emission efficiency, a high brightness, and a wide viewing angle.

FIG. 1 is a circuit diagram illustrating a structure of one pixel of a general organic light-emitting display device, and illustrates a pixel structure that are configured with two N-type transistors. FIG. 2 is exemplary diagrams respectively showing images displayed by a panel of the general organic light-emitting display device, and illustrates a state in which a logo 1 is displayed at a specific portion of an image.

As illustrated in FIG. 1, a pixel 50 of the general organic light-emitting display device are configured with an organic light-emitting diode OLED and at least two or more transistors T1 and T2 that are connected a data line DL and a gate line GL to control the organic light-emitting diode OLED.

An anode of the organic light-emitting diode OLED is connected to a first power source VDD, and a cathode of the organic light-emitting diode OLED is connected to a second power source VSS. The organic light-emitting diode OLED generates light having a certain brightness in correspondence with a current supplied from a second transistor T2.

Various circuit elements included in the pixel 50 control an amount of current supplied to the organic light-emitting diode OLED in correspondence with an image signal supplied to the data line DL when a scan signal is supplied to the gate line GL. To this end, the pixel 50 includes: the second transistor T2 (a driving transistor) that is connected between the first power source VDD and the organic light-emitting diode OLED; a first transistor T1 (a switching transistor) that is connected between the second transistor T2, the data line DL, and the gate line GL; and a storage capacitor Cst that is connected between a gate of the second transistor T2 and the organic light-emitting diode OLED.

Since the above-described organic light-emitting display device uses the organic light-emitting diode OLED that is a self-emitting element, deterioration can be made by various causes. When a deterioration difference between pixels occurs, a brightness difference and a color-sense difference are discerned, and a permanent image sticking remains.

That is, when the same data having a high brightness is continued due to a self-emitting characteristic of the organic light-emitting diode OLED, deterioration is caused by an object having a certain shape, causing a regularly-shaped image sticking in which the shape is recognized as an image sticking.

The regularly-shaped image sticking is progressively intensified in proportion to a degree of deterioration of the organic light-emitting diode OLED, and at the limit in which a reduction in brightness is recognized by a user, a service life of the organic light-emitting diode OLED is acknowledged as coming to an end.

The regularly-shaped image sticking is caused by a logo or the like. The logo bring the regularly-shaped image sticking recognition limit forward, and thus shortens a service life of the organic light-emitting display device.

For example, as shown in a portion (a) of FIG. 2, when a logo or various subtitles 1 (hereinafter referred to as a logo) is continuously displayed in a certain region for a long time, a plurality of the organic light-emitting diodes OLED corresponding to the region in which the logo 1 is displayed can be deteriorated. In this case, even though the logo 1 is vanished, an image sticking of the logo 1 can remain in the region.

In order to prevent an image sticking caused by the logo 1, a related art method compares pixel data for each frame to find a position of a logo, and lowers a brightness of image data corresponding to the position of the logo.

That is, the related art method compares all pixel data of a current frame and pixel data of a previous frame to determine a region, which has the same pixel data in a certain number or more of frames, as a logo region, and lowers a brightness of image data outputted to the logo region, thus preventing the logo region from being deteriorated.

To provide an additional description, the related art method compares pixel data (10 bit×4 sub-pixels, input video data) of a current frame and pixel data of a previous frame at a corresponding position (the same position). When the same or similar value is repeated in a certain number or more of frames, the related art method determines a corresponding region as a logo region, and when the pixel data of the current frame differ from those of the previous frame, the related art method determines a corresponding region as a non-logo region. The related art method applies a brightness reduction gain to a portion determined as the logo region irrespective of a peripheral portion, thereby lowering a brightness of the portion.

The related art method has the following problems.

First, the related art method does not consider a fact that a logo is classified into a background and an edge. That is, the related art method does not perform a special processing on an edge. For this reason, when a brightness of a logo region is lowered, an image quality of an edge portion is degraded.

For example, a portion (b) of FIG. 2 shows the logo displayed in the portion (a) of FIG. 2, and the letters 'OCN' is displayed at a portion of the logo region which is determined as having the logo. However, the logo region includes a portion except the letter itself (a background), namely, an internal space of the letter 'O', a space opened from the center to a right side of the letter 'C', and a space opened from a lower end to an upper end of the letter 'N'.

However, as shown in a portion (c) of FIG. 2, the related art method uniformly lowers an entire brightness of the logo region which is determined as having the logo, and consequently lowers a brightness of a portion corresponding to an actual logo, namely, a brightness of regions near the actual logo portion, in addition to a brightness of a region corresponding to the letters 'OCN' themselves. For this reason, an entire image quality of the logo region is degraded.

Second, the related art method reduces a brightness of the logo region without considering a brightness value near the logo region. Therefore, when a brightness near the logo region becomes higher and thus a portion near the logo region becomes brighter, the logo region is shown as being relatively dark, causing a degradation in image quality.

SUMMARY

A timing controller includes: a logo detecting unit configured to compare a plurality of frames to detect a logo region; an edge detecting unit configured to detect an edge, corresponding to a boundary between the logo region and an external region of the logo region, from the logo region by using a change amount of brightness between the logo region and the external region; a brightness compensating unit configured to reduce a brightness of the logo region including the edge; and an output unit configured to output image data whose a brightness is compensated for by the brightness compensating unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
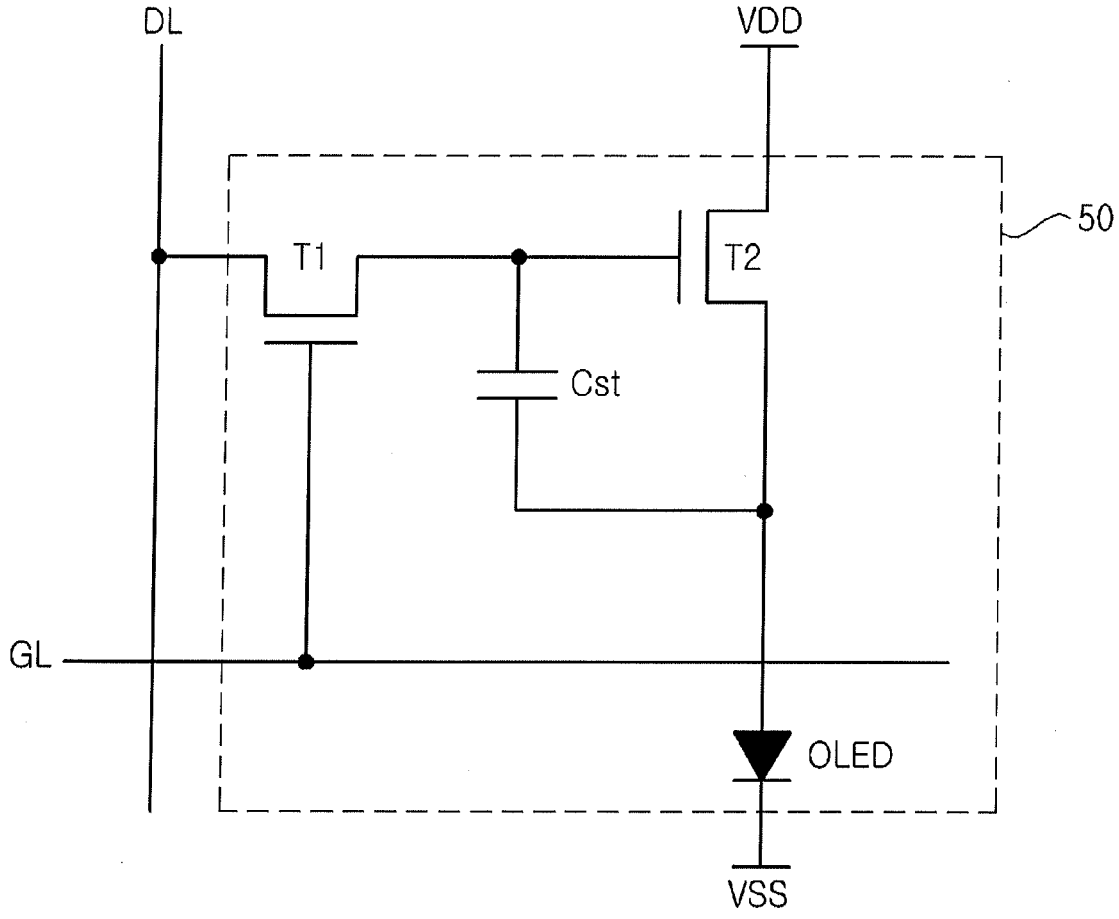
FIG. 1 [ Related Art ]
FIG. 1 is a circuit diagram illustrating a structure of one pixel of a general organic light-emitting display device.
Figure 2:
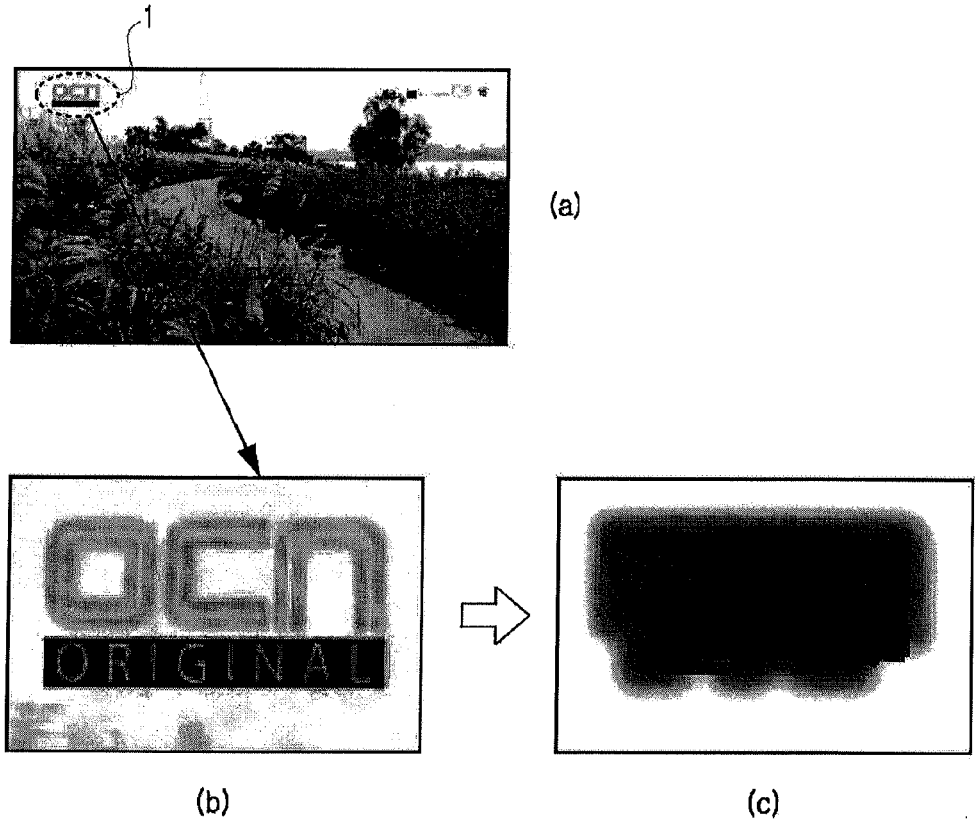
FIG. 2 [ Related Art ]
FIG. 2 is exemplary diagrams respectively showing images displayed by a panel of the general organic light-emitting display device.
Figure 3:
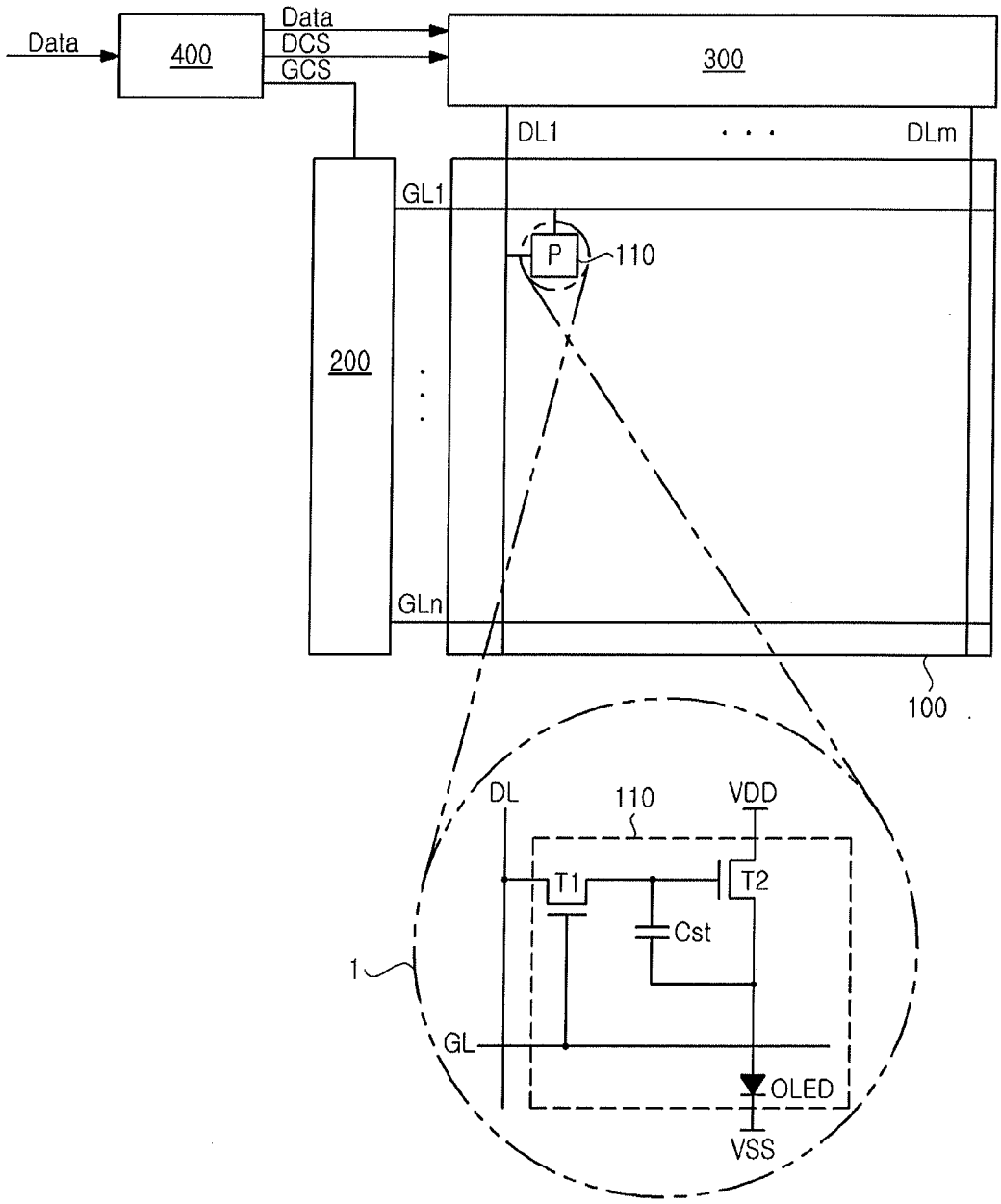
FIG. 3 is an exemplary diagram illustrating a configuration of a display device using a timing controller according to the present invention.

FIG. 3 is an exemplary diagram illustrating a configuration of a display device using a timing controller according to the present invention.

A timing controller 400 according to the present invention may be applied to liquid crystal display (LCD) devices, and moreover may be applied to organic light-emitting display devices driven with WRGB data by using color filters. That is, due to a still image such as a logo, the LCD devices can be deteriorated, and particularly, the organic light-emitting display devices can be severely deteriorated. To solve such a problem, an organic light-emitting display device driven with WRGB data by using color filters will be described below as an example of the present invention.

A display device according to the present invention, as illustrated in FIG. 3, may include: a panel 100; a gate driver 200 that includes at least one or more gate driving integrated circuits (ICs) for driving a plurality of gate lines formed in the panel 100; a data driver 300 that includes at least one or more source driving ICs for driving a plurality of data lines formed in the panel 100; and a timing controller 400 that controls the gate driving ICs and the source driving ICs.

The panel 100 includes a plurality of sub-pixels 110 that are respectively formed in a plurality of areas defined by intersections between the plurality of gate lines and the plurality of data lines. The sub-pixels 110 may include a white (W) sub-pixel, a red (R) sub-pixel, a green (G) sub-pixel, and a blue (B) sub-pixel. An arrangement type of the sub-pixels 110 may be variously changed. The sub-pixels 110 may output light of a unique color, but output white light. In the latter, the panel 100 may include a plurality of color filters for respectively outputting a white color, a red color, a green color, and a blue color.

Each of the sub-pixels 110, as illustrated in an enlarged circular block 1 of FIG. 3, may include an organic light-emitting diode OLED and at least two or more transistors T1 and T2 that are connected to a corresponding data line DL and a corresponding gate line GL, and control the organic light-emitting diode OLED.

The organic light-emitting diode OLED has an anode connected to a first power source VDD and a cathode connected to a second power source VSS. The organic light-emitting diode OLED generates light having a certain brightness with a current supplied from a second transistor T2.

Various circuit elements of the sub-pixel 110 controls an amount of current supplied to the organic light-emitting diode OLED according to an image signal supplied to the data line DL when a scan signal is supplied to the gate line GL. To this end, the sub-pixel 110 includes the second transistor T2 (a driving transistor) connected between the first power source VDD and the organic light-emitting diode OLED, a first transistor T1 (a switching transistor) connected between the second transistor T2 and the data line DL, and a storage capacitor Cst connected between a gate of the second transistor T2 and the organic light-emitting diode OLED.

The timing controller 400 generates a gate control signal GCS for controlling an operation timing of the gate driving ICs and a data control signal DCS for controlling an operation timing of the source driving ICs, by using a timing signal (i.e., a vertical sync signal Vsync, a horizontal signal Hsync, and a data enable signal DE) inputted from an external system. The timing controller 400 receives input video data from the external system to generate image data to be transferred to the source driving ICs of the data driver 300.

The timing controller 400 according to the present invention may detect an edge of a logo to reduce a brightness of only the edge of the logo except an outer portion of the logo, or reduce a brightness of the logo by using a brightness near the logo. Alternatively, by using all of such two methods, the timing controller 400 may reduce a brightness of the logo.

A detailed configuration and function of the timing controller 400 according to the present invention that performs the above-described function will be described in detail with reference to FIGS. 4 to 9.

Each of the gate driving ICs configuring the gate driver 200 supplies the scan signal to the plurality of gate lines by using a plurality of the gate control signals GCS generated by the timing controller 400.

The gate driving ICs applied to the present invention may use a plurality of gate driving ICs, applied to a related art flat panel display device, as-is. The gate driving ICs applied to the present invention may be provided independently from the panel 100, and may be electrically connected to the panel 100 in various types, for example, a gate-in panel (GIP) type in which the gate driving ICs are mounted on the panel 100.

Each of the source driving ICs configuring the data driver 300 convert output image data transferred from the timing controller 400 into analog image signals, and respectively supplies the image signals for one horizontal line to a plurality of corresponding data lines at every one horizontal period for which the scan signal is supplied to one gate line.

The source driving ICs convert the output image data into the image signals by using a plurality of gamma voltages supplied from a gamma voltage generator (not shown), and respectively output the image signals to the plurality of data lines. To this end, each of the source driving ICs includes a shift register, a latch, a digital-to-analog converter (DAC), and an output buffer.

Figure 4:
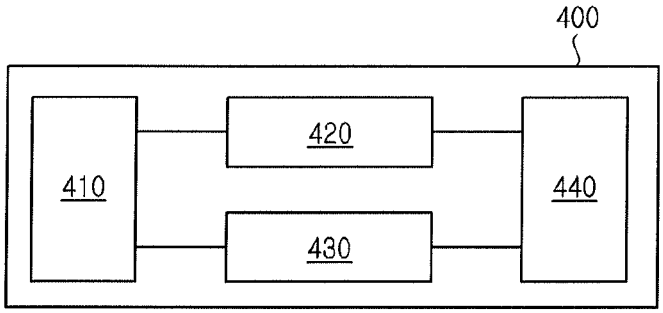
FIG. 4 is an exemplary diagram illustrating an internal configuration of a timing controller according to the present invention.

FIG. 4 is an exemplary diagram illustrating an internal configuration of a timing controller according to the present invention.

The timing controller 400 according to the present invention, as illustrated in FIG. 4, may include: a receiver 410 that receives the timing signal and the input video data from the external system; a data aligner 430 that detects an edge of a logo region to reduce a brightness of only the edge of the logo region except an external region of the logo region, or reduces a brightness of the logo region by using a brightness of the external region of the logo region, or by using all of these two methods, reduces the brightness of the logo region; a control signal generator 420 that generates the gate control signal GCS and the data control signal DCS by using the timing signal transferred from the receiver 410; and a transferer 440 that transfers image data outputted from the data aligner 430 and the data control signal DCS outputted from the control signal generator 420 to the data driver 300, and transfers the gate control signal GCS outputted from the control signal generator 420 to the gate driver 200.

The receiver 410 receives the input video data and the timing signal from the external system, and transfers the input video data to the data aligner 420. The timing signal received through the receiver 410 may be directly transferred from the receiver 410 to the control signal generator 420, or may be transferred to the control signal generator 420 via the data aligner 420.

The control signal generator 420 generates the gate control signal GCS for controlling a timing of the gate driver 200 and the gate control signal for controlling a timing of the data driver 300 by using a plurality of the timing signals received from the receiver 410.

The data aligner 430 may detect a logo region, detect an edge of the logo region, and reduce a brightness of the logo region including the edge.

Moreover, the data aligner 430 may detect a logo region, and control a reduction rate of a brightness of the logo region by using a brightness of an external region of the logo region.

Moreover, the data aligner 430 may detect a logo region, detect an edge of the logo region, and control a reduction rate of a brightness of the logo region including the edge by using a brightness of an external region of the logo region.

In addition, the data aligner 430 outputs image data whose a brightness is compensated for by the above-described function. A detailed configuration and function of the data aligner 430 will be described in detail with reference to FIGS. 5 to 11.

Figure 5:
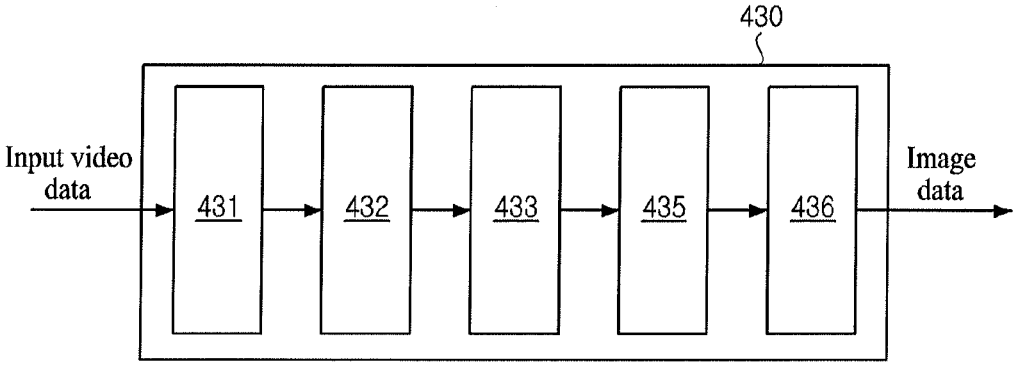
FIG. 5 is an exemplary diagram illustrating a detailed configuration of a data aligner of the timing controller according to the present invention.
Figure 6:
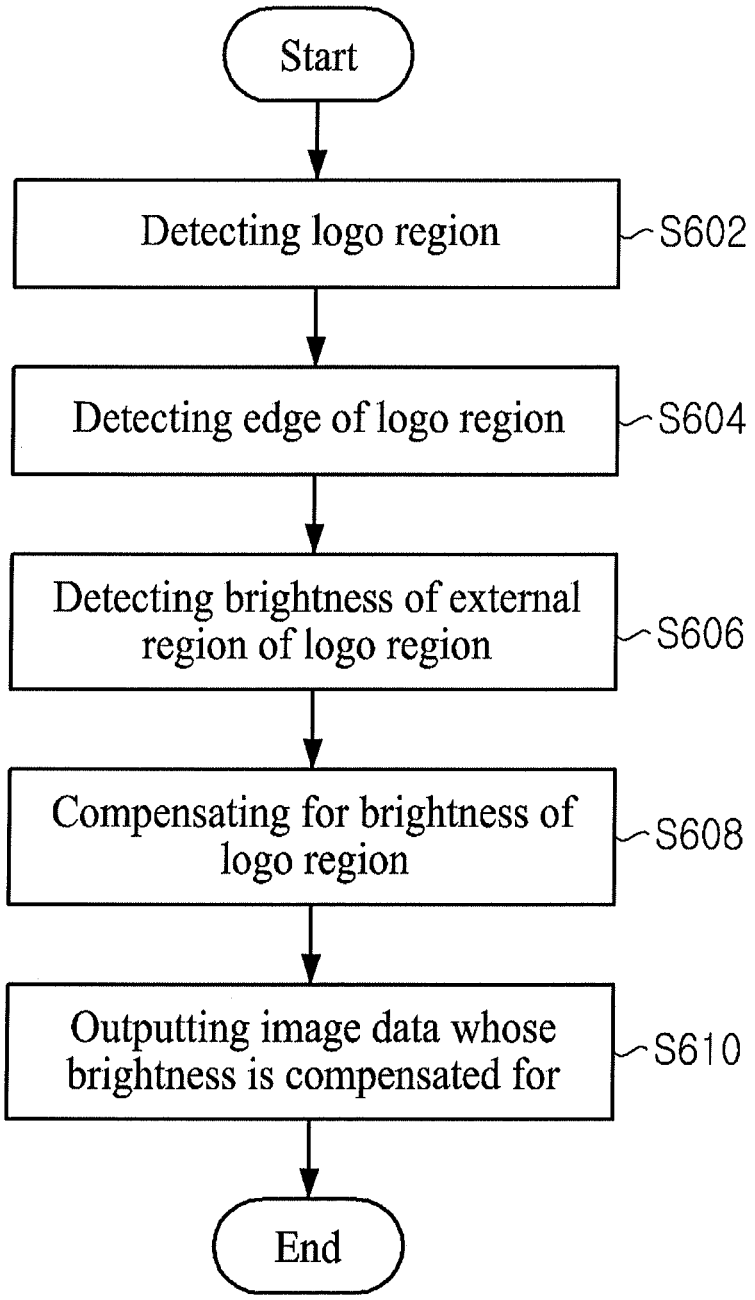
FIG. 6 is a flowchart illustrating a method of driving the timing controller according to an embodiment of the present invention.
Figure 7:
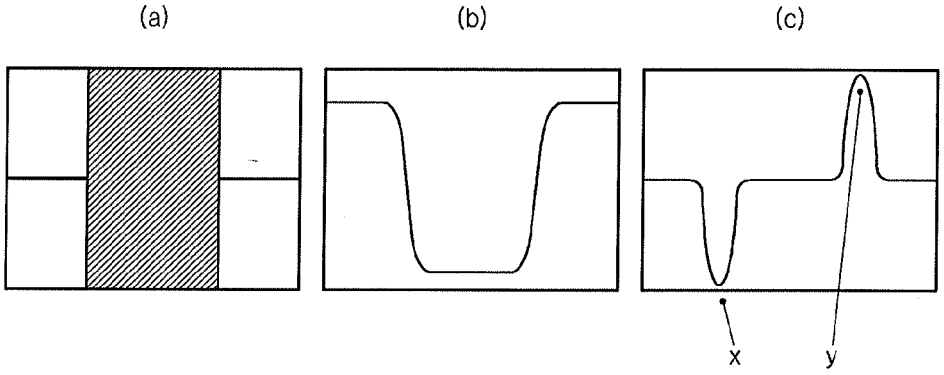
FIG. 7 is exemplary diagrams for describing an edge detecting method applied to the method of driving the timing controller according to an embodiment of the present invention.
Figure 8:
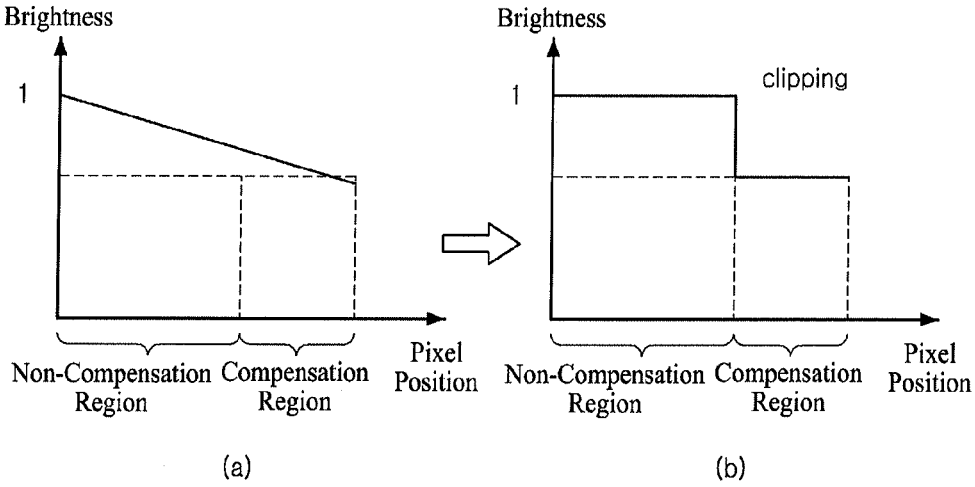
FIG. 8 is exemplary diagrams showing a method of compensating for brightness according to the edge detecting method applied to the method of driving the timing controller according to an embodiment of the present invention.
Figure 9:
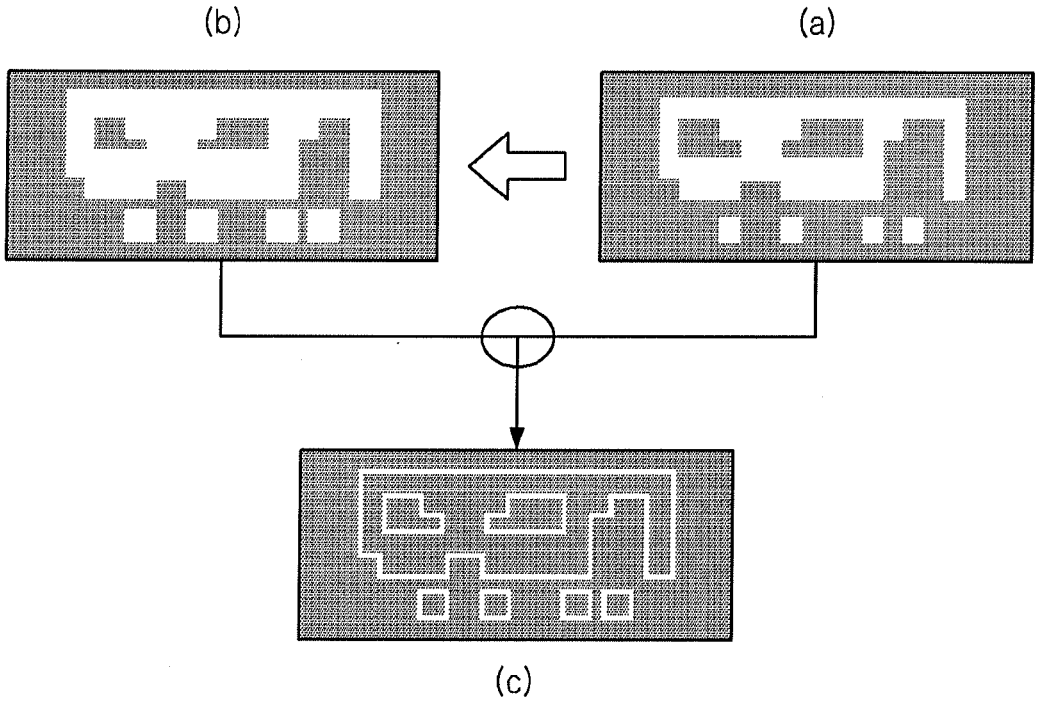
FIG. 9 is exemplary diagrams for describing a logo-outer region detecting method applied to the method of driving the timing controller according to an embodiment of the present invention.
Figure 10:
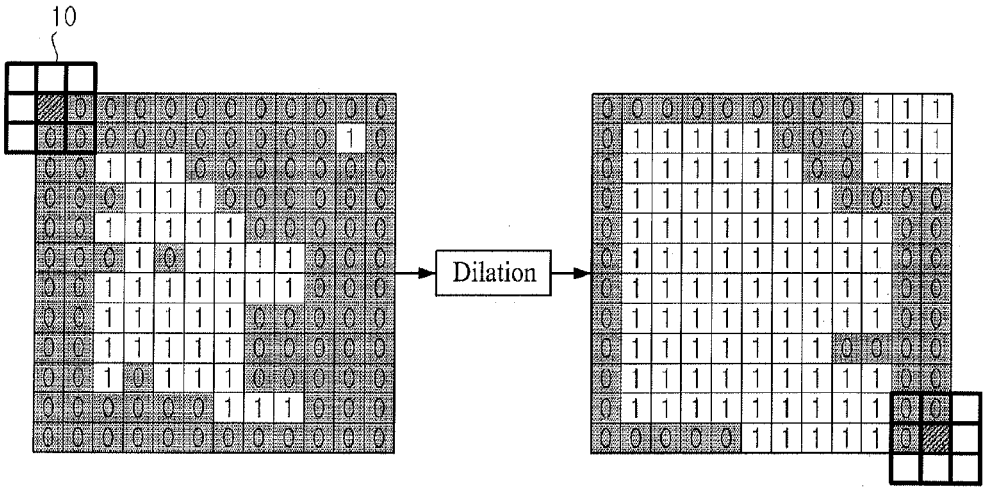
FIG. 10 is exemplary diagrams for describing a method of using a mask in the logo-outer region detecting method applied to the method of driving the timing controller according to an embodiment of the present invention.
Figure 11:
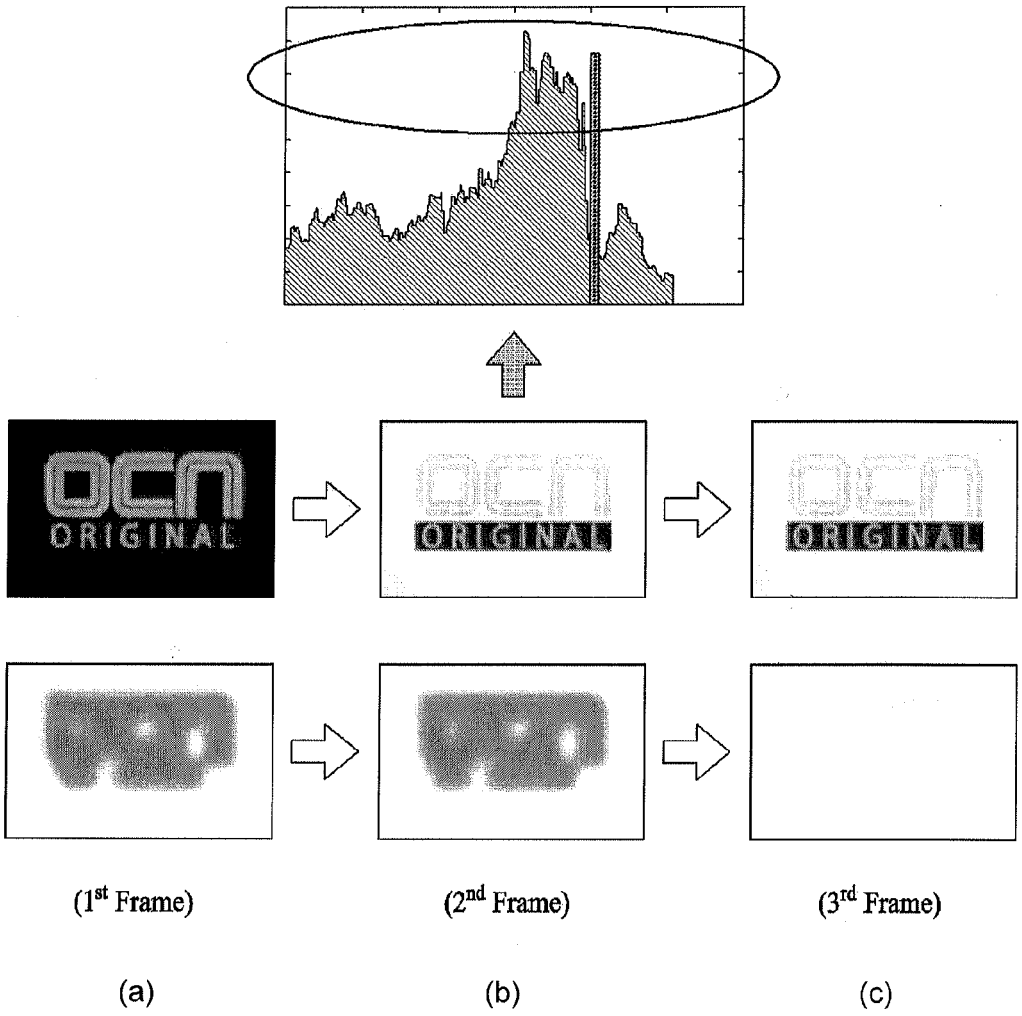
FIG. 11 is exemplary diagrams showing a state in which a brightness reduction rate of a logo region is varied by the method of driving the timing controller according to an embodiment of the present invention.

FIG. 5 is an exemplary diagram illustrating a detailed configuration of the data aligner of the timing controller according to the present invention, FIG. 6 is a flowchart illustrating a method of driving the timing controller according to an embodiment of the present invention, FIG. 7 is exemplary diagrams for describing an edge detecting method applied to the method of driving the timing controller according to an embodiment of the present invention, FIG. 8 is exemplary diagrams showing a method of compensating for brightness according to the edge detecting method applied to the method of driving the timing controller according to an embodiment of the present invention, FIG. 9 is exemplary diagrams for describing a logo-outer region detecting method applied to the method of driving the timing controller according to an embodiment of the present invention, FIG. 10 is exemplary diagrams for describing a method of using a mask in the logo-outer region detecting method applied to the method of driving the timing controller according to an embodiment of the present invention, and FIG. 11 is exemplary diagrams showing a state in which a brightness reduction rate of a logo region is varied by the method of driving the timing controller according to an embodiment of the present invention.

The data aligner 430, as illustrated in FIG. 5, includes: a logo detecting unit 431 that compares a plurality of frames to detect a logo region; an edge detecting unit 432 that detects an edge corresponding to a boundary between the logo region and an external region of the logo region by using a change amount of brightness between the logo region and the external region; an external region brightness detecting unit 433 that detects a brightness of the external region of the logo region; a brightness compensating unit 435 that controls a reduction rate of the brightness of the logo region including the edge by using the brightness of the external region, and reduces the brightness of the logo region including the edge according to the reduction rate; and an output unit 436 that output image data whose a brightness is compensated for by the brightness compensating unit 435.

The logo detecting unit 431 compares a plurality of frames to detect a logo region in operation S602. The logo region may be detected by various methods.

As a first example, the logo region may be detected by a related art method. In detail, the logo detecting unit 431 may compare pixel data of a current frame and pixel data of a previous frame to determine a region, having the same pixel data during a certain number or more of frames, as the logo region.

To provide an additional description, the logo detecting unit 431 compares pixel data (10 bit×4 sub-pixels, input video data) of a current frame and pixel data of a previous frame at a corresponding position (the same position). When the same or similar value is repeated in a certain number or more of frames, the logo detecting unit 431 determines a corresponding region as a logo region, and when the pixel data of the current frame differ from those of the previous frame, the related art method determines a corresponding region as a non-logo region.

As a second example, the logo region may be detected in units of a block including a plurality of pixels.

To this end, the logo detecting unit 431 determines where there is a logo in units of each block of a plurality of blocks configuring one frame. That is, the logo detecting unit 431 does not determine whether there is a logo in units of a frame but determines whether there is the logo in units of each block among a plurality of blocks configuring a frame.

A method, which divides a frame into a plurality of blocks and determines whether there is a logo in units of each block of the plurality of blocks, may be variously implemented. Hereinafter, an example of a method that determines whether there is a logo in units of each block of a plurality of blocks configuring a frame will be described.

The logo detecting unit 431 compares change amounts of data in pixels corresponding to each of a plurality of frames, stores a comparison value (the compared value) in a block memory that matches a block corresponding to the pixels, and determines whether a logo is being displayed in a block that matches the block memory, by using the comparison value stored in each of a plurality of the block memories.

To this end, the logo detecting unit 431 may include: a frame memory unit that stores input video data included in an N−1st frame; a block accumulator that compares change amounts of input image data in pixels corresponding to each other and accumulates a comparison value in a block memory that matches a block corresponding to the pixels, in the N−1 st frame and an Nth frame in which data are being currently inputted; and a logo block determiner that determines whether a logo is included in a block that matches the block memory, by using an accumulation value stored in each of a plurality of the block memories.

The frame memory stores input video data included in a frame in units of a frame.

Here, the input video data may be input video data inputted from the external system, or may be data that are generated by being primarily converted in the timing controller before being inputted to the frame memory.

It is assumed that when a frame that is currently stored in the frame memory is the N−1st frame, a frame that is currently and newly inputted to the frame memory is the Nth frame The block accumulator receives input video data included in the N−1st frame stored in the frame memory and input video data included in the Nth frame which is being currently inputted to the frame memory.

The block accumulator compares change amounts of input video data in pixels corresponding to each other in the Nth frame and the N−1st frame, and accumulates and stores a comparison value in a block memory that matches a block corresponding to the pixels.

The block denotes each of a plurality of regions into which one screen displayed by the panel 100 is divided.

For example, when the panel 100 is a full-high definition (HD) panel using a plurality of WRGB sub-pixels, the number of horizontal-line pixels is 1,920, the number of vertical-line pixels is 1,080, each of the pixels include four sub-pixels (a W sub-pixel, an R sub-pixel, a G sub-pixel, and a B sub-pixel), and image data of each of the sub-pixels is composed of 10 bits. Therefore, the number of pixels included in one frame is 1920 (the number of horizontal-line pixels)×1080 (the number of vertical-line pixels). Here, the number (four) of sub-pixels is not considered.

In this case, when one block is composed of 8×8 pixels, a total of 260 (=1920/8) blocks are generated on a horizontal line of the one frame, the panel, or a screen, and a total of 135 (=1080/8) blocks are generated on a vertical line.

Hereinafter, the above-described example will be described as an example of the present invention.

The block accumulator compares input video data of pixels corresponding to each other in the N−1 st frame and the Nth frame to calculate a change amount of the input video data.

When a pixel difference value between two pieces of input video data is less than a predetermined threshold value, the block accumulator may set a value of each of the pixels to 0, and store the value of 0 in a block memory corresponding to the pixels. That is, when pixel Difference value < threshold value, a comparison value of the pixels may be set to 0. Here, the threshold value is a factor for adjusting a characteristic of an image or an accuracy of logo detection, and may be variously set in consideration of various factors.

Moreover, when the pixel difference value between the two pieces of input video data is greater than or equal to the predetermined threshold value, the block accumulator may set a value of each of the pixels to 1, and store the value of 1 in the block memory corresponding to the pixels. That is, when pixel difference value ≥ threshold value, a comparison value of the pixels may be set to 1.

For example, a plurality of the comparison values in a first block (1B) among all blocks are stored in a first block memory (1BM) corresponding to the first block (1B).

That is, a block memory unit including block memories equal to the number of blocks generated in each of the frames is provided in the block accumulator.

In this case, the total sum of comparison values for the pixels included in the first block (1B), namely, the total sum of accumulated comparison values included in the enlarged circular block, is 48, and thus, 48 that is an accumulation value of the comparison values is stored in the first block memory (1BM).

A comparison value of pixels included in a block corresponding to each of the block memories is accumulated and stored in each of the block memories.

A method of accumulating the comparison value may be sequentially performed for all pixels of the panel 100.

In the above-described method, a plurality of comparison values for pixels which are formed on first to 1080th horizontal lines are sequentially accumulated in first to 32400th block memories (1BM) to (32400BM).

As described above, when an arithmetic operation is performed by using a block composed of 8×8 pixels, in simple comparison with a related art pixel-unit arithmetic operation, it can be seen that a use rate of memory decreases by about 1/64 with respect to full HD.

In the related art pixel-unit arithmetic operation, 1920×1080×10 bit memories are needed, but in the present invention, (1920×1080×10 bit)/8×8 memories are needed, a use rate of memory can decrease by a rate corresponding to the number of pixels of a block memory.

As described above, in the N−1st frame and the Nth frame, a comparison value of pixels is accumulated in each of the block memories of the block memory unit, in units of a block.

When such an operation is ended, the input video data of the Nth frame are stored in the frame memory 431, and then input video data of an N+1st frame are inputted.

Therefore, the block accumulator repeatedly performs the comparison value storing operation for the Nth frame and the N+1st frame.

When a plurality of comparison values are accumulated in each block memory of the block memory unit through the above-described operation, the logo block determiner determines whether a logo is included in each block, by using an accumulation value stored in each block memory.

The logo block determiner calculates an average accumulation value of pixels for determining whether there is a logo in each block to extract a block in which the logo is displayed, by using an infinite impulse response (IIR) filter. That is, the logo block determiner determines whether there is the logo in each of the blocks (1B to 32400BM).

Here, the IIR filter denotes a digital filter in which a continuous time of an impulse response is infinite.

A calculation of the IIR filter is expressed as Equation (1).

$$S_n = S_{n-1} \cdot k + A_n \cdot (1-k) \quad (1)$$

To arrange Equation (1), Equation (1) may be expressed as "IIR_Block_Countn=IIR_Block_Countn−1×(0.06)+avg (IIR_Block_Countn)×(0.994)".

In Equation (1), An denotes Block_Count, k is 0.06 (parameter), and Sn−1=An denotes an average value of previous data. Here, Block_Count denotes an accumulation value stored in the block memory.

The logo block determiner uses an accumulation value of comparison values calculated for each frame. Especially, a plurality frames are successively inputted, and in consideration of the accumulation value being continuously changed, the logo block determiner gives more weight on a previous accumulation value (an accumulation value calculated in the N−1 st frame) and a current accumulation value (an accumulation value calculated in the Nth frame), and determines whether there is a logo in each block. Like this, by giving more weight on the accumulation value, the logo block determiner prevents noise data, and thus prevents an error from occurring in determining whether there is a logo.

To provide an additional description, the present invention uses the IIR filter for determining a block including a logo, and particularly, by giving different weights on an accumulation value of a previous frame (the N−1st frame) and an accumulation value of a current frame (the Nth frame), the present invention removes noise data, thus securing an accuracy and stability of logo detection.

As described above, the logo block determiner calculates comparison values stored in each of the block memories by using the IIR filter, thereby determining whether a logo is included in each of blocks connected to the respective block memories.

In operation S602, the logo detecting unit 431 may detect a logo region by using various methods in addition to two above-described methods.

The second method is a method that compares frames in units of a block composed of a plurality of pixels to detect a logo region, and is a modification example of the first method that compares frames in units of a pixel to detect a logo region. Other methods also need an operation that compares pixels of each frame in detail.

Hereinafter, for convenience of description, a method that detects a logo by using the first method will be described as an example of the present invention.

Subsequently, the edge detecting unit 432 detects an edge of the logo region by using a change amount of brightness between the logo region and an external region of the logo region in operation S604.

Here, the edge denotes a portion of the logo region corresponding to a boundary between the logo region and the external region. That is, the edge is an outermost region of the logo region, and forms the external region from a portion adjacent to the edge to an outer portion of the logo region. Therefore, the edge is included in the logo region.

The edge detecting unit 432 detects the edge through a process of FIG. 7.

In a first process, the edge detecting unit 432 generates a profile function curve (as shown in portion (b) of FIG. 7) that expresses a brightness of pixels which are disposed at an outer portion of the logo region.

Generally, a logo is composed of letters or a figure, and an edge of the letters or figure, as shown in a portion (a) of FIG. 7, may be composed of a line having black or a specific color.

Therefore, a brightness of pixels formed along a line direction on the abscissa axis in the portion (a) of FIG. 7 is extracted, and a profile curve shown in a portion (b) of FIG. 7 is generated by using the brightness.

In a second process, the edge detecting unit 432 performs a differential operation (see portion (c) of FIG. 7) on the profile function curve shown in the portion (b) of FIG. 7 to detect pixels, corresponding to a portion having a differential value of x or y, which is higher than a predetermined threshold value, as an edge.

That is, when a differential operation is performed on a profile function curve shown in the portion (b) of FIG. 7, a differential value of x or y corresponding to a rapidly changed pixels brightness portion obtained as a high value. Therefore, when a threshold value is set, the edge detecting unit 432 may detect a portion, having a differential value of x or y, which is higher than the predetermined threshold value, as the edge.

The brightness compensating unit 435 reduces a brightness of the logo region including the edge, and thus prevents a deterioration of the logo region in operation S608.

In this case, by detecting the edge, the logo region (i.e., a compensation region) including the edge and the external region (i.e., a non-compensation region) are clearly differentiated, and thus, as shown a portion (b) of FIG. 8, the brightness compensating unit 435 reduces only a brightness of the compensation region according to a predetermined brightness reduction rate.

On the other hand, in the related art, a logo region (a compensation region) whose a brightness should be reduced is not clearly differentiated from a non-logo region (an external region) whose a brightness is not required to be reduced. Therefore, as shown a portion (a) of FIG. 8, a related art brightness compensation unit clearly reduces a brightness at a boundary between the logo region and the non-logo region.

Therefore, according to the present invention, a brightness of the external region and a brightness of the logo region are clearly differentiated by the edge corresponding to a boundary between the logo region and the external region, and thus, even when the brightness of the logo region is reduced, an image quality is not degraded.

That is, according to the present invention, despite the brightness of the logo region being reduced, the edge of the logo region is clearly displayed, and thus, an image quality is not degraded.

When the present invention uses only operation S604 of detecting the edge, operation S608 of compensating for a brightness may be performed immediately after the edge is detected by the edge detecting unit 432.

However, when the present invention additionally uses operation S606 of detecting the brightness of the external region of the logo region, edge detecting operation S604 performed by the edge detecting unit 432 and external region brightness detecting operation S606 performed by the external region brightness detecting unit 433 are all ended, and then the brightness of the logo region including the edge is compensated for by using the brightness reduction rate which is extracted through external region brightness detecting operation S606.

When the present invention uses only operation S606 of detecting the brightness of the external region of the logo region, operation S608 of compensating for a brightness may be performed immediately after operation S606 of detecting the brightness of the external region.

In the present invention, despite two operations S604 and S606 being all performed, operation S608 of compensating for a brightness is not necessarily required to be performed after two operations S604 and S606. That is, the brightness compensating unit 435 may terminate brightness compensating operation S608 according to an operation that is first performed among two operations S604 and S606, and then may again perform brightness compensating operation S608 according to an operation that is subsequently performed.

Next, a method in which the external region brightness detecting unit 433 detects the brightness of the external region of the logo region will be described in operation S606.

Here, the external region denotes all regions except the logo region including the edge. That is, when there is one screen displayed by one frame, all portions except the logo region are included in the external region.

A logo-outer region to be described below denotes a region in which a plurality of pixels adjacent to the edge are formed in the external region.

The external region brightness detecting unit 433 detects a brightness of the logo-outer region in the external region through a process of FIGS. 9 and 10.

In a first process, the external region brightness detecting unit 433 enlarges the logo region shown in a portion (a) of FIG. 9 by using a mask enlarging method shown in FIG. 10 to generate the enlarged logo region (hereinafter referred simply to as an enlargement logo region) shown in a portion (b) of FIG. 9.

The mask enlarging method uses a mask 10 shown in FIG. 10. In FIG. 10, a 3×3 mask 10 is illustrated as an example of the mask 10, but masks having various sizes may be used without being limited thereto.

When the logo region detected through logo region detecting operation S602 or edge detecting operation S604 is composed of a plurality of pixels illustrated as 1 in FIG. 10, as shown in FIG. 10, the external region brightness detecting unit 433 sequentially substitutes the mask 10 into the pixels shown in FIG. 10. In FIG. 10, a screen composed of 12×12 pixels may denote one frame, or denote a portion including a logo region and some of external regions of the logo region in the one frame. Hereinafter, the screen composed of the 12×12 pixels is simply referred to as a frame. Also, for convenience of description, a screen shown in FIG. 9 is referred to as a frame.

FIG. 10 is for describing a method of changing the logo region, shown in the portion (a) of FIG. 9, to the enlargement logo region shown in the portion (b) of FIG. 9.

When a pixel composing a central portion of the mask 10 is disposed at a pixel (i.e., a pixel included in the logo region) illustrated as 1 in the frame, the external region brightness detecting unit 433 changes all values of other eight pixels of the mask 10 among the pixels included in the frame, in addition to the pixel illustrated as 1 in the frame, to 1.

Through the above-described process, the number of portions illustrated as 1 in the frame shown in FIG. 10 increases. This denotes the logo region shown in the portion (a) of FIG. 9 being enlarged to the enlargement logo region shown in the portion (b) of FIG. 9.

In other words, when a logo region (i.e., the original logo region of the frame shown in FIG. 10) before the mask 10 is applied has a shape shown in the portion (a) of FIG. 9, an enlargement logo region enlarged after the mask 10 is applied is as shown in the portion (b) of FIG. 9.

In a second process, as shown in a portion (c) of FIG. 9 the brightness detecting unit 433 excludes the logo region from the enlargement logo region to select a logo-outer region.

A range of the enlargement logo region shown in the portion (b) of FIG. 9 is broader than the logo region shown in the portion (a) of FIG. 9, and thus, by excluding the logo region from the enlargement logo region, only the logo-outer region shown in the portion (c) of the FIG. 9 is selected.

The logo-outer region may be a portion of the external region adjacent to the edge. That is, the logo-outer region is a portion of the external region most adjacent to the logo region.

In a third process, the brightness detecting unit 433 detects a brightness of the logo-outer region to select a brightness reduction rate of the logo region.

A method of detecting the brightness of the logo-outer region may use a general method which is currently used for brightness detection.

That is, detecting the brightness of the logo-outer region is to detect a brightness outside the logo region.

When the brightness of the logo-outer region is detected by the process, the brightness detecting unit 433 selects a brightness reduction rate of the logo region according to the brightness of the logo region.

When the brightness of the logo-outer region is high, the brightness detecting unit 433 selects a low brightness reduction rate, thereby preventing a logo region with reduced brightness from being easily discerned by a user's eyes.

On the other hand, when the brightness of the logo-outer region is low, the brightness detecting unit 433 selects a high brightness reduction rate, thereby much reducing the brightness of the logo region.

Here, the brightness reduction rate denotes a rate of an actual brightness of the logo region and a brightness to be reduced. The brightness being high denotes changing the brightness of the logo region to a far lower brightness than the actual brightness, and the brightness being low denotes changing the brightness of the logo region to a low brightness almost similar to the actual brightness.

Subsequently, the brightness compensating unit 435 reduces the brightness of the logo region according to the brightness reduction rate.

At this time, as described above, the brightness compensating unit 435 may compensate for the logo region, including the edge detected in edge detecting operation S604, according to the brightness reduction rate.

As described above, the present invention calculates a histogram of brightness values of a periphery (the logo-outer region) of the logo region for each frame, and when a high-brightness pixel is higher than a reference value, the present invention reduces the brightness reduction rate of the logo region. In this case is shown in a portion (c) of FIG. 11.

Since a brightness of a logo-outer region is detected as high as a brightness detection result of the logo-outer region for a frame (a second frame) shown in a portion (b) of FIG. 11, the brightness of the logo region is a little reduced, or is not reduced, in a third frame.

In this case, a histogram analysis for the logo-outer region is performed after a corresponding frame. Therefore, applying a brightness reduction rate detected from the second frame shown in the portion (b) of FIG. 11 is reflected in the third frame that is a frame subsequent to the second frame shown in the portion (b) of FIG. 11. In this case, a brightness value may be set to a Y value which is obtained by converting RGB data into YUV.

On the other hand, a brightness of a logo-outer region of a first frame shown in a portion (a) of FIG. 11 is detected as low, and thus, a high brightness reduction rate is applied to a brightness of a logo region in the second frame.

When a brightness near the logo region is high, a blur caused by a reduction in brightness of the logo region is clearly visible to eyes, and thus, as described above, the present invention selects a brightness reduction rate of the logo region by using the brightness of the logo-outer region.

Finally, the image data outputted from the brightness compensating unit 435 are transferred to the data driver 300 through the output unit 436. In this case, the image data outputted from the brightness compensating unit 435 may be directly transferred to the data driver 300 through the output unit 436, or may undergo another conversion operation performed by the other elements of the timing controller 400 and then may be transferred to the data driver 300.

An operation of aligning the image data according to a characteristic and structure of the panel 100 may be performed by the brightness compensating unit 435, or performed by the output unit 436. Also, the alignment operation may be previously applied to the input video data inputted to the logo detecting unit 431.

The present invention detects a logo region in an image displayed by the organic light-emitting display device, and reduces a brightness of the logo region, thus preventing a deterioration image sticking in the organic light-emitting display device. Also, the present invention performs edge detecting operation S604 and bright reduction rate selecting operation S606 with the consideration of a brightness of a logo-outer region, and thus can prevent a reduction in image quality near the logo region and prevent blurring in a text logo region.

That is, the present invention selects an edge and a brightness reduction rate, thus maintaining a sharpness of a logo region whose a brightness is reduced.

As described above, the present invention detects a logo region, detects an edge of the logo region, and reduces a brightness of the logo region including the edge, thus enhancing a sharpness of the logo region.

Moreover, the present invention selects a brightness reduction rate of the logo region by using a brightness near the logo region, and thus, when a periphery of the logo region becomes brighter, the present invention can prevent the logo region from being blurred because a brightness of the logo region is excessively reduced.

That is, the present invention reduces the brightness of the logo region, and thus can prevent a deterioration of an organic light-emitting element and enhance a sharpness and definition of the logo region.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A timing controller of an Organic Light Emitting Diode (OLED) display, comprising:

a processor with circuit elements configured to:

compare a plurality of frames to detect a logo region, wherein each frame is divided into a plurality of pixel blocks arranged into an array, with corresponding average accumulation pixel data value of each of the plurality of pixel blocks being stored to corresponding block memories;

detect an edge from the pixel blocks of only the logo region which corresponds to a boundary between the logo region and an external region of the logo region, using an infinite impulse response (IIR) filter to determine a change amount of brightness corresponding to the average accumulation pixel data values between the pixel blocks of logo region only and the pixel blocks of external region, wherein the determination of the change amount of brightness corresponding to the average accumulation pixel data values between the pixel blocks of logo region only and the pixel blocks of external region is according to an equation:

$$S_n = S_{n-1} \cdot k + A_n \cdot (1-k)$$

wherein An denotes Block_Count, k is 0.06 (parameter), and Sn−1 denotes an average value of previous data, and Block_Count denotes the accumulation pixel value stored in the corresponding block memories;

reduce a brightness of the logo region only comprising the edge; and output image data to the OLED display whose brightness is compensated for by reducing image-sticking caused by the logo region.

2. The timing controller of claim 1, wherein the processor with circuit elements when performing edge detecting, is configured to generate a profile curve that expresses a brightness of pixels which are disposed at an outer portion of the logo region only, and perform a differential operation on the profile curve to detect pixels, corresponding to a portion having a differential value higher than a predetermined threshold value, as the edge.

3. A timing controller of an Organic Light Emitting Diode (OLED) display, comprising:

a processor with circuit elements configured to:

compare a plurality of frames to detect a logo region, wherein each frame is divided into a plurality of pixel blocks arranged into an array, with corresponding average accumulation pixel data value of each of the plurality of pixel blocks being stored to corresponding block memories;

detect a brightness from the pixel blocks of an external region of the logo region only, wherein the logo region is established by comparing a plurality of frames and detect an edge boundary between the logo region and an external region of the logo region, using an infinite impulse response (IIR) filter to determine a change amount of brightness corresponding to the average accumulation pixel data values between the pixel blocks of logo region only and the pixel blocks of external region, wherein the determination of the change amount of brightness corresponding to the average accumulation pixel data values between the pixel blocks of logo region only and the pixel blocks of external region is according to an equation:

$$S_n=S_{n-1}\cdot k+A_n\cdot(1-k)$$

wherein An denotes Block_Count, k is 0.06 (parameter), and Sn−1 denotes an average value of previous data, and Block_Count denotes the accumulation pixel value stored in the corresponding block memories;

control a reduction rate of the brightness of the logo region only by using the brightness of the external region, and reduce the brightness of the logo region only according to the reduction rate; and output image data to the OLED display whose brightness is compensated for by reducing image-sticking caused by the logo region.

4. The timing controller of claim 3, wherein the processor with circuit elements when performing external region brightness detecting, is configured to enlarge the logo region only using a mask enlarging method to generate an enlargement logo region, exclude the logo region from the enlargement logo region to select a logo-outer region, and detect a brightness of the logo-outer region.

5. A timing controller of an Organic Light Emitting Diode (OLED) display, comprising:

a processor with circuit elements configured to:

compare a plurality of frames to detect a logo region, wherein each frame is divided into a plurality of pixel blocks arranged into an array, with corresponding average accumulation pixel data value of each of the plurality of pixel blocks being stored to corresponding block memories;

detect an edge from the pixel blocks of only the logo region which corresponds to a boundary between the logo region and an external region of the logo region, using an infinite impulse response (IIR) filter to determine a change amount of brightness corresponding to the average accumulation pixel data values between the pixel blocks of logo region only and the pixel blocks of external region, wherein the determination of the change amount of brightness corresponding to the average accumulation pixel data values between the pixel blocks of logo region only and the pixel blocks of external region is according to an equation:

$$S_n=S_{n-1}\cdot k+A_n\cdot(1-k)$$

wherein An denotes Block_Count, k is 0.06 (parameter), and Sn−1 denotes an average value of previous data, and Block_Count denotes the accumulation pixel value stored in the corresponding block memories;

detect a brightness of the external region of the logo region;

control a reduction rate of the brightness of the logo region comprising the edge by using the brightness of the external region, and reduce the brightness of the logo region comprising the edge according to the reduction rate; and output image data to the OLED display whose brightness is compensated for by reducing image-sticking caused by the logo region.

6. A method of driving a timing controller of an Organic Light Emitting Diode (OLED) display, the method comprising:

one or more processor with circuit elements in the timing controller, performing:

comparing a plurality of frames to detect a logo region, wherein each frame is divided into a plurality of pixel blocks arranged into an array, with corresponding average accumulation pixel data value of each of the plurality of pixel blocks being stored to corresponding block memories;

detecting an edge from the pixel blocks of only the logo region which corresponds to a boundary between the logo region and an external region of the logo region, using an infinite impulse response (IIR) filter to determine a change amount of brightness corresponding to the average accumulation pixel data values between the pixel blocks of logo region only and the pixel blocks of external region, wherein the determination of the change amount of brightness corresponding to the average accumulation pixel data values between the pixel blocks of logo region only and the pixel blocks of external region is according to an equation:

$$S_n=S_{n-1}\cdot k+A_n\cdot(1-k)$$

wherein An denotes Block_Count, k is 0.06 (parameter), and Sn−1 denotes an average value of previous data, and Block_Count denotes the accumulation pixel value stored in the corresponding block memories;

detecting a brightness of the external region of the logo region only;

controlling a reduction rate of the brightness of the logo region comprising the edge by using the brightness of the external region, and reducing the brightness of the logo region comprising the edge according to the reduction rate; and outputting image data to the OLED display whose brightness is compensated for by reducing image-sticking caused by the logo region.

7. The method of claim 6, wherein the detecting of an edge comprises generating a profile curve that expresses a brightness of pixels which are disposed at an outer portion of the logo region only, and performing a differential operation on the profile curve to detect pixels, corresponding to a portion having a differential value higher than a predetermined threshold value, as the edge.

8. The method of claim 6, wherein the detecting of a brightness of the external region comprises enlarging the logo region by using a mask enlarging method to generate an enlargement logo region, excluding the logo region from the enlargement logo region to select a logo-outer region, and detecting a brightness of the logo-outer region.

9. The method of claim 6, wherein, the detecting of an edge comprises generating a profile curve that expresses a brightness of pixels which are disposed at an outer portion of the logo region only, and performing a differential operation on the profile curve to detect pixels, corresponding to a portion having a differential value higher than a predetermined threshold value, as the edge, and the detecting of a brightness of the external region comprises enlarging the logo region by using a mask enlarging method to generate an enlargement logo region, excluding the logo region from the enlargement logo region to select a logo-outer region, and detecting a brightness of the logo-outer region.

10. An Organic Light Emitting Diode (OLED) display device comprising:

a panel in which a plurality of pixels are respectively formed in a plurality of areas defined by intersections between a plurality of gate lines and a plurality of data lines;

a timing controller comprising:

a processor with circuit elements configured to:

compare a plurality of frames to detect a logo region, wherein each frame is divided into a plurality of pixel blocks arranged into an array, with corresponding average accumulation pixel data value of each of the plurality of pixel blocks being stored to corresponding block memories;

detect an edge from the pixel blocks of only the logo region which corresponds to a boundary between the logo region and an external region of the logo region, using an infinite impulse response (IIR) filter to determine a change amount of brightness corresponding to the average accumulation pixel data values between the pixel blocks of logo region only and the pixel blocks of external region, wherein the determination of the change amount of brightness corresponding to the average accumulation pixel data values between the pixel blocks of logo region only and the pixel blocks of external region is according to an equation:

$$S_n=S_{n-1}\cdot k+A_n\cdot(1-k)$$

wherein An denotes Block_Count, k is 0.06 (parameter), and Sn−1 denotes an average value of previous data, and Block_Count denotes the accumulation pixel value stored in the corresponding block memories;

reduce a brightness of the logo region comprising the edge; and output image data whose a brightness is compensated for by reducing image-sticking caused by the logo region;

a data driver configured to convert the image data transferred from the timing controller into analog image signals, and respectively supply the image signals to the plurality of data lines; and a gate driver configured to output a scan signal to a corresponding gate line according to a control signal transferred from the timing controller at every one horizontal period for which the image signals are outputted.

11. The Organic Light Emitting Diode (OLED) display device of claim 10, wherein the processor with circuit elements when performing edge detecting, is configured to generate a profile curve that expresses a brightness of pixels which are disposed at an outer portion of the logo region only, and perform a differential operation on the profile curve to detect pixels, corresponding to a portion having a differential value higher than a predetermined threshold value, as the edge.

12. An Organic Light Emitting Diode (OLED) display device comprising:

a panel in which a plurality of pixels are respectively formed in a plurality of areas defined by intersections between a plurality of gate lines and a plurality of data lines;

a timing controller comprising:

a processor with circuit elements configured to:

compare a plurality of frames to detect a logo region, wherein each frame is divided into a plurality of pixel blocks arranged into an array, with corresponding average accumulation pixel data value of each of the plurality of pixel blocks being stored to corresponding block memories;

detect an edge from the pixel blocks of only the logo region which corresponds to a boundary between the logo region and an external region of the logo region, using an infinite impulse response (IIR) filter to determine a change amount of brightness corresponding to the average accumulation pixel data values between the pixel blocks of logo region only and the pixel blocks of external region, wherein the determination of the change amount of brightness corresponding to the average accumulation pixel data values between the pixel blocks of logo region only and the pixel blocks of external region is according to an equation:

$$S_n=S_{n-1}\cdot k+A_n\cdot(1-k)$$

wherein An denotes Block Count, k is 0.06 (parameter), and Sn−1 denotes an average value of previous data, and Block Count denotes the accumulation pixel value stored in the corresponding block memories;

control a reduction rate of the brightness of the logo region only by using the brightness of the external region, and reduce the brightness of the logo region only according to the reduction rate; and output image data to the OLED display whose brightness is compensated for by the brightness compensating unit to reduce image-sticking caused by the logo region;

a data driver configured to convert the image data transferred from the timing controller into analog image signals, and respectively supply the image signals to the plurality of data lines; and a gate driver configured to output a scan signal to a corresponding gate line according to a control signal transferred from the timing controller at every one horizontal period for which the image signals are outputted.

13. The Organic Light Emitting Diode (OLED) display device of claim 12, wherein the processor with circuit elements when performing external region brightness detecting, is configured to enlarge the logo region only using a mask enlarging method to generate an enlargement logo region, exclude the logo region from the enlargement logo region to select a logo-outer region, and detect a brightness of the logo-outer region.

14. An Organic Light Emitting Diode (OLED) display device comprising:

a panel in which a plurality of pixels are respectively formed in a plurality of areas defined by intersections between a plurality of gate lines and a plurality of data lines;

a timing controller comprising:

a processor with circuit elements configured to:

compare a plurality of frames to detect a logo region, wherein each frame is divided into a plurality of pixel blocks arranged into an array, with corresponding average accumulation pixel data value of each of the plurality of pixel blocks being stored to corresponding block memories;

detect an edge from the pixel blocks of only the logo region which corresponds to a boundary between the logo region and an external region of the logo region, using an infinite impulse response (IIR) filter to determine a change amount of brightness corresponding to the average accumulation pixel data values between the pixel blocks of logo region only and the pixel blocks of external region, wherein the determination of the change amount of brightness corresponding to the average accumulation pixel data values between the pixel blocks of logo region only and the pixel blocks of external region is according to an equation:

$$S_n=S_{n-1}\cdot k+A_n\cdot(1-k)$$

wherein An denotes Block_Count, k is 0.06 (parameter), and Sn−1 denotes an average value of previous data, and Block_Count denotes the accumulation pixel value stored in the corresponding block memories;

detect a brightness of the external region of the logo region;

control a reduction rate of the brightness of the logo region comprising the edge by using the brightness of the external region, and reduce the brightness of the logo region comprising the edge according to the reduction rate; and output image data to the OLED display whose brightness is compensated for by the brightness compensating unit to reduce image-sticking caused by the logo region, a data driver configured to convert the image data transferred from the timing controller into analog image signals, and respectively supply the image signals to the plurality of data lines; and a gate driver configured to output a scan signal to a corresponding gate line according to a control signal transferred from the timing controller at every one horizontal period for which the image signals are outputted.

* * * * *